United States Patent [19]

Fujita et al.

[11] Patent Number: 4,638,205

[45] Date of Patent: Jan. 20, 1987

[54] PIEZO-ELECTRIC TRANSDUCER

[75] Inventors: Hideo Fujita; Yuichi Saito; Masatoshi Miura, all of Tokyo, Japan

[73] Assignee: TDK Electronics Co., Ltd., Tokyo, Japan

[21] Appl. No.: 257,652

[22] Filed: Apr. 27, 1981

[30] Foreign Application Priority Data

| | | | |
|---|---|---|---|
| May 6, 1980 | [JP] | Japan | 55-6061[U] |
| Oct. 7, 1980 | [JP] | Japan | 55-142329[U] |
| Dec. 17, 1980 | [JP] | Japan | 55-180137[U] |

[51] Int. Cl.[4] ..... H01L 41/08

[52] U.S. Cl. ..... 310/312; 310/324

[58] Field of Search ..... 310/321, 322, 324, 312, 310/366; 179/110 A, 115 R, 115 A, 115 ES, 110 C, 181 R, 138, 180; 181/157, 158, 164, 165, 168, 170, 173, 174; 340/384 E

[56] References Cited

U.S. PATENT DOCUMENTS

| | | | |
|---|---|---|---|
| 2,870,521 | 1/1959 | Rudnick | 310/312 X |
| 3,707,131 | 12/1972 | Massa | 310/324 |
| 4,035,672 | 7/1977 | Beaverson et al. | 310/324 |
| 4,156,156 | 5/1979 | Sweany et al. | 310/312 |
| 4,193,647 | 3/1980 | Guess | 310/312 X |
| 4,302,695 | 11/1981 | Boyles et al. | 310/322 |

FOREIGN PATENT DOCUMENTS

| | | | |
|---|---|---|---|
| 2335495 | 1/1975 | Fed. Rep. of Germany | 310/312 |
| 0032651 | 3/1977 | Japan | 310/312 |
| 2079101 | 1/1982 | United Kingdom | 179/110 A |

*Primary Examiner*—Mark O. Budd

*Attorney, Agent, or Firm*—Oblon, Fisher, Spivak, McClelland & Maier

[57] ABSTRACT

A piezo-electric transducer includes a piezo-electric ceramic sheet bonded to a vibrating reed and one or more electrodes bonded to the piezo-electric ceramic sheet, wherein said vibrating reed has a plurality of through-holes on a vibrational nodal line for vibration of the vibrating reed.

1 Claim, 12 Drawing Figures

PIEZO-ELECTRIC TRANSDUCER

BACKGROUND OF THE INVENTION

1. Field of the Invention

The present invention relates to a piezo-electric transducer. More particularly, it relates to a piezo-electric transducer which is suitable for piezo-electric buzzer for generating audio sound.

2. Description of the Prior Arts

Recently, it has been found a tendency for utilizing a piezo-electric buzzer using a piezo-electric device, instead of the conventional electromagnetic buzzer. Thus, the frequency in the oscillation of the piezo-electric buzzer is depending upon a thickness and a diameter of a vibration diaphragm whereby high tone is given by a small size piezo-electric buzzer to cause a disadvantageously unpleasant sound.

SUMMARY OF THE INVENTION

It is an object of the present invention to provide a piezo-electric buzzer which generates relatively low tone and can oscillate stably in a desired mode even though it is in a small size.

The foregoing and other objects of the present invention have been attained by providing a piezo-electric transducer comprising a piezo-electric ceramic sheet bonded to a vibrating reed in one piece wherein a plurality through-holes are formed in the vibrating reed on a nodal line for vibration of the vibrating reed.

DETAILED DESCRIPTION OF THE PREFERRED EMBODIMENTS

Figure 1:
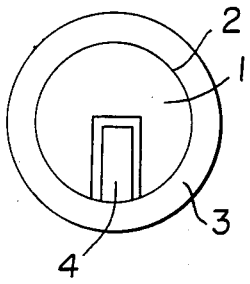
FIG. 1 is a plane view of one embodiment of the conventional piezo-electric transducer.

FIG. 1 is a plane view of a conventional piezo-electric transducer used for a piezo-electric buzzer. An electrode (1) is formed on one surface of a piezo-electric ceramic disc (2) and a metallic sheet (3) as a vibrating reed is bonded on the other surface of the piezo-electric ceramic disc (2) and a feed-back electrode (4) is also formed.

Figure 2:
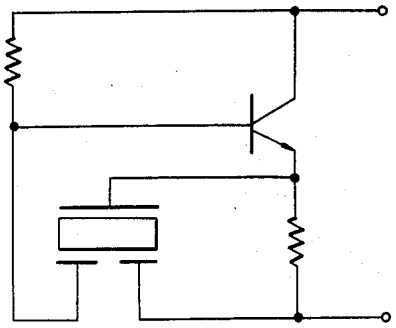
FIG. 2 is a circuit diagram of one embodiment of a circuit for driving the piezo-electric transducer.

The piezo-electric transducer is held on the nodal line for vibration with a free vibrating peripheral part and is driven by a driving circuit shown in FIG. 2. Sound is generated at a frequency depending upon a resonance frequency of a vibrating reed given depending upon diameters and thicknesses of the metallic sheet and the piezo-electric ceramic disc. Such piezo-electric buzzer causes unpleasant feeling if the frequency of the output sound is too high. As a home buzzer, it is preferable to reduce the resonance frequency.

In order to reduce the resonance frequency of the vibrating reed, the diameter is increased or the thickness is decreased. Thus, it is not easy to prepare a thin vibrating reed having a large diameter in an industrial process. Moreover, a mechanical strength can not be so high and a cost can not be so low disadvantageously. In order to assemble a small size device, a small outer size of the piezo-electric transducer is desired. A small piezo-electric buzzer which does not generate excessive high tone is desired.

Figure 3:
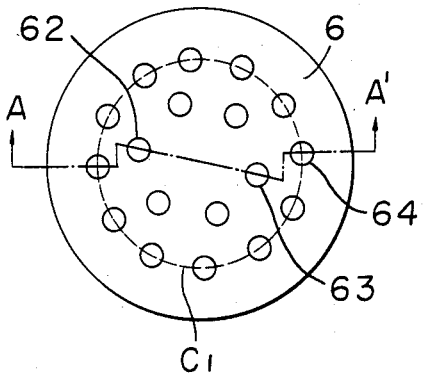
FIG. 3 is a plane view of one embodiment of piezo-electric transducer of the present invention.
Figure 6:
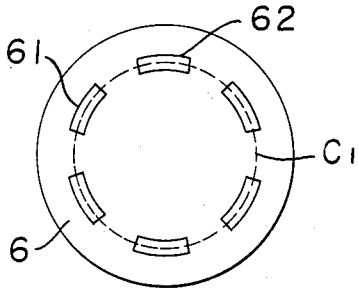
FIGS. 5 and 6 are respectively plane views of the other embodiments of the present invention.
Figure 5:
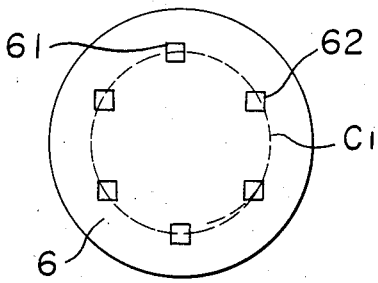
Figure 4:
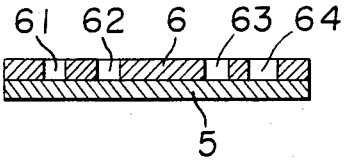
FIG. 4 is a sectional view taken along the line A—A' of FIG. 3.

FIG. 3 is a plane view of one embodiment of the piezo-electric transducer of the present invention. FIG. 4 is a sectional view taken along the line A—A' of FIG. 3. The reference numeral (5) designates a piezo-electric ceramic sheet; (6) designates a vibrating reed bonded to the piezo-electric ceramic sheet (5) in one piece. The reference $C_1$ designates a nodal circle of the vibrating reed (6) in its vibration and (61) and (64) designate small through-holes formed in the vibrating reed (6) on the nodal circle $C_1$ for vibration.

In accordance with the embodiment of the present invention, the frequency can be reduced without reducing its acoustic intensity in comparison with the conventional piezo-electric vibrating reed having the same size and the same shape which has not a through-hole.

In accordance with experiments, a piezo-electric transducer comprising a vibrating reed disc having a diameter of 16.8 mm and a thickness of 80 μm bonded to a piezo-electric ceramic disc having no hole which has a diameter of 16.8 mm and a thickness of 70 μm had a resonance frequency of about 4 KHz. On the other hand, the piezo-electric transducer comprising the same piezo-electric ceramic disc and the vibrating reed disc having the same size but having through-holes having each diameter 1.6 mm at positions shown in FIG. 3 had a resonance frequency of about 3.1 KHz. It has been confirmed that the resonance frequency can be remarkably reduced by forming the through-holes.

The resonance frequencies in the cases of the vibrating reed discs having the through-holes having each diameter of 1.2 mm or 2.0 mm are respectively 3.4 KHz and 3.5 KHz. The reduction of the resonance frequency has been found in each case. In these cases, the acoustic intensity was not reduced.

As described, the resonance frequency of the piezo-electric transducer can be reduced by forming the through-holes on the nodal circular line for vibration.

In view of the reduction of variation of vibrating mode and the prevention of generation of higher harmonic wave, it is preferable to form the through-holes on the nodal circular line with substantially equal space. The sectional view of the through-hole is not limited to be circular hole, but it can be square or curved slender hole. The shape of the vibrating reed is not limited to be disc shape, but it can be other shapes such as rectangular shape. The effect for reducing the resonance frequency can be reduced by forming through-holes on the nodal line for vibration as described.

Figure 7:
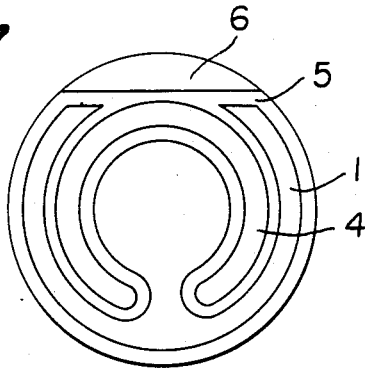
FIG. 7 is a plane view of a rear surface of one embodiment of the piezo-electric transducer.

As shown in FIG. 7, in the piezo-electric transducer, the electrode (1) and the feed-back electrode (4) are formed on the piezo-electric ceramic sheet and the electrodes (1), (4) are connected with the metallic disc (6)

through the driving circuit so as to result in the vibration.

The piezo-electric transducer can be used not only for the piezo-electric buzzer, but also for other various devices such as a piezo-electric speaker equipped in a watch, a clock or an electric computer etc..

Figure 8:
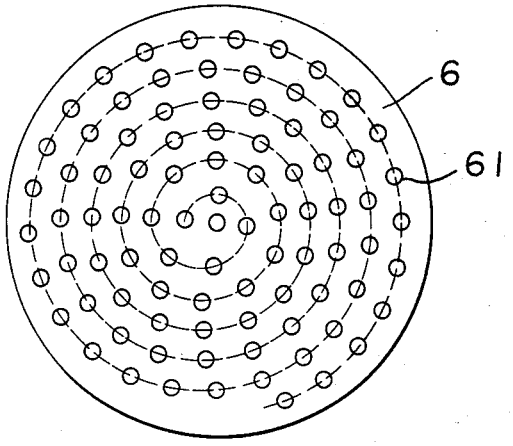
FIG. 8 is a plane view of the other embodiment of the piezo-electric transducer of the present invention.
Figure 9:
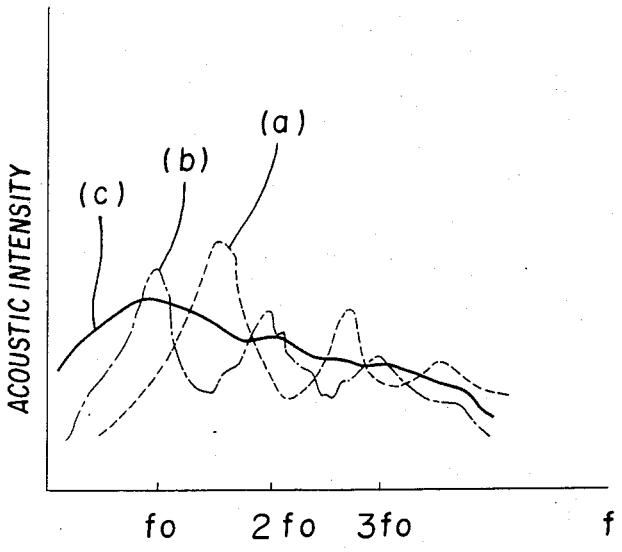
FIG. 9 is a graph showing a relation of acoustic intensity to frequency.

In the other embodiment of the piezo-electric transducer shown in FIG. 8, the through-holes (61) are formed in the metallic disc (6) as the vibrating reed in a spiral form from the center to the peripheral part so as to place some of the through-holes on the nodal line for vibration. According to this embodiment, the higher order mode level of the circle is reduced whereby the second and third order resonance peaks are substantially eliminated together with the reduction of the resonance frequency, as described in FIG. 9 as the curve (c). In FIG. 9, the curve (a) shows the resonance frequency of the conventional piezo-electric transducer having no through-hole and the curve (b) shows the resonance frequency of the embodiment shown in FIG. 3. The resonance frequency of the curve (b) or (c) is remarkably reduced from that of the curve (a) without substantial reduction of the acoustic intensity. In the curve (c), the resonance peaks are substantially eliminated.

In the embodiment shown in FIG. 8, the shape of the through-holes can be also modified in a desired shape.

Figure 10:
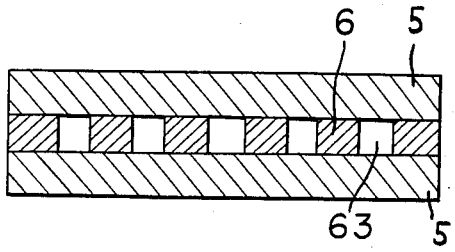
FIG. 10 is a sectional view of the other embodiment of the piezo-electric transducer of the present invention.
Figure 11:
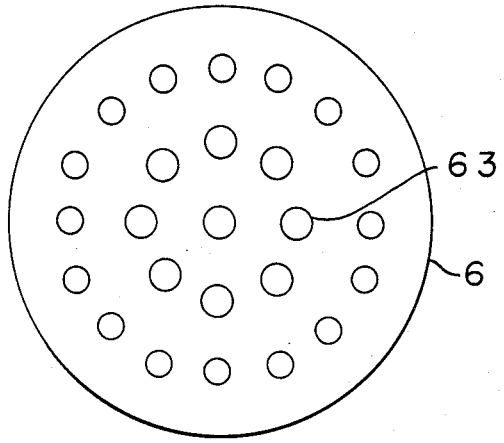
FIG. 11 is a plane view of the embodiment of FIG. 10.

In the other embodiment shown in FIGS. 10 and 11, the piezo-electric ceramic sheets (5) are bonded to both surfaces of the metallic disc (6) having a plurality of through-holes on the nodal line, as the vibrating reed.

Figure 12:
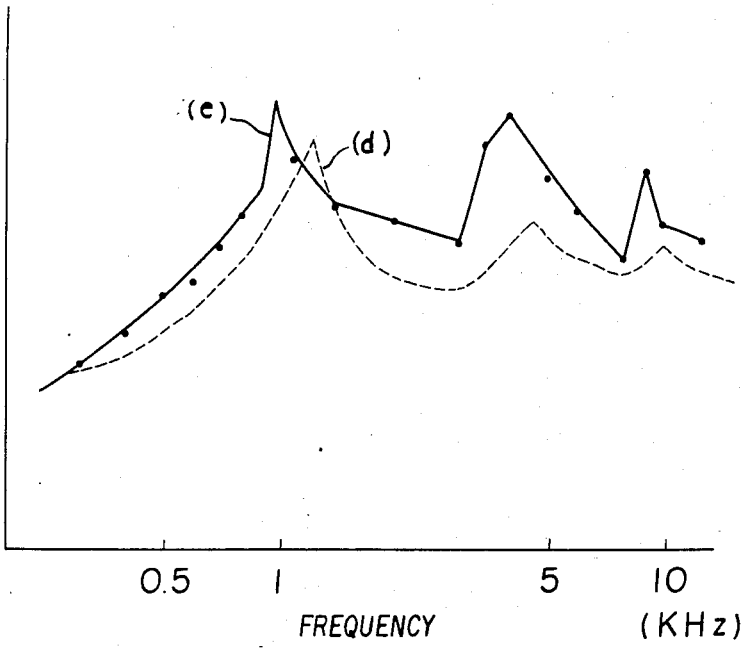
FIG. 12 is a graph showing a relation of acoustic intensity to frequency.

In accordance with the embodiment bonding the piezo-electric ceramic sheets (5) on both surfaces of the vibrating reed (6) having through-holes (63), the frequency characteristic having superior response in lower frequency band is given as described by the curve (e) in FIG. 12. Moreover, the peeling-off of the piezo-electric ceramic sheets are prevented, even though the acoustic intensity is remarkably high and the thickness of the vibrating reed can be reduced in view of a mechanical intensity.

For example, two piezo-electric ceramic sheets having each diameter of 30 mm and a thickness of 0.1 mm are bonded to both surfaces of the vibrating reed made of a beryllum and copper having a thickness of 10 to 60 $\mu$m in one piece, the frequency characteristic is given by the curve (e) in FIG. 12. This is compared with the curve (d) for the embodiment bonding one piezo-electric ceramic sheet (5) to the vibrating reed (6).

When the former is continuously used under the driving condition for imparting the acoustic intensity of 100 dB in a distance for about 10 cm from the piezo-electric ceramic sheet, any peeling-off is not caused.

We claim:

1. In a first piezo-electric transducer comprising a piezo-electric ceramic sheet bonded to a vibrating reed and one or more electrodes bonded to said piezo-electric ceramic sheet, an improvement wherein said vibrating reed has a first plurality through-holes formed on a nodal line for vibration of said vibrating reed, wherein said vibrating reed has a second plurality of through-holes which are not formed on said nodal line and wherein each of said first and second plurality of through-holes are arranged in such a manner that a spiral form of holes is formed from the center to the peripheral part of said vibrating reed.

* * * * *

UNITED STATES PATENT AND TRADEMARK OFFICE

CERTIFICATE OF CORRECTION

PATENT NO. : 4,638,205

DATED : January 20, 1987

INVENTOR(S) : Fujita, et al.

It is certified that error appears in the above-identified patent and that said Letters Patent is hereby corrected as shown below:

--Priority data recorded incorrectly.
First line should read thus:

May 6, 1980 [JP] Japan.....55-60651[U]--

Signed and Sealed this

Fourteenth Day of April, 1987

*Attest:*

DONALD J. QUIGG

*Attesting Officer*

*Commissioner of Patents and Trademarks*